US008635997B2

(12) United States Patent
Schultz et al.

(10) Patent No.: US 8,635,997 B2
(45) Date of Patent: Jan. 28, 2014

(54) SYSTEMS AND METHODS FOR CONTROLLING GAS PRESSURE TO GAS-FIRED APPLIANCES

(75) Inventors: Michael W. Schultz, Elk River, MN (US); Glenn R. Bergum, St. Anthony, MN (US)

(73) Assignee: Honeywell International Inc., Morristown, NJ (US)

( * ) Notice: Subject to any disclaimer, the term of this patent is extended or adjusted under 35 U.S.C. 154(b) by 1568 days.

(21) Appl. No.: 11/550,775

(22) Filed: Oct. 18, 2006

(65) Prior Publication Data

US 2008/0124668 A1 May 29, 2008

(51) Int. Cl.
*F24H 9/20* (2006.01)

(52) U.S. Cl.
USPC ..... 126/116 A; 431/64; 431/89; 431/90; 122/14.21; 122/17.1

(58) Field of Classification Search
USPC ..... 126/116 A; 431/64, 89, 90, 18; 122/14.21, 17.1
See application file for complete search history.

(56) References Cited

U.S. PATENT DOCUMENTS

| | | | | |
|---|---|---|---|---|
| 4,202,760 | A * | 5/1980 | Storey et al. | 252/364 |
| 4,329,138 | A | 5/1982 | Riordan | |
| 4,373,897 | A * | 2/1983 | Torborg | 431/20 |
| 4,533,315 | A * | 8/1985 | Nelson | 431/20 |
| 4,915,615 | A * | 4/1990 | Kawamura et al. | 431/41 |
| 5,520,533 | A * | 5/1996 | Vrolijk | 431/90 |
| 5,630,408 | A * | 5/1997 | Versluis | 122/14.21 |
| 5,720,231 | A | 2/1998 | Rowlette et al. | |
| 5,806,440 | A | 9/1998 | Rowlette et al. | |
| 6,571,817 | B1 * | 6/2003 | Bohan, Jr. | 137/88 |
| 6,749,423 | B2 * | 6/2004 | Fredricks et al. | 431/90 |
| 6,866,202 | B2 | 3/2005 | Sigafus et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 2004/0043345 | A1 * | 3/2004 | Jaeschke | 431/18 |
| 2005/0159844 | A1 | 7/2005 | Sigafus et al. | |

OTHER PUBLICATIONS

Honeywell, VK41..RNK81..R Series, Gas Controls With Integrated Gas/Air Module for Combined Valve and Ignition System, pp. 1-6, prior to Oct. 18, 2006.
Honeywell, 45.801.175-, Amplification Gas/Air Module for VK4105R/VK8105R Gas Controls, pp. 1-8, prior to Oct. 18, 2006.
http://www.regal-beloit.com/gedraft.html, Welcom to GE Commercial Motors by Regal-Beloit, 1 page, printed Apr. 26, 2006.

* cited by examiner

*Primary Examiner* — Avinash Savani
(74) *Attorney, Agent, or Firm* — Seager, Tufte & Wickhem, LLC.

(57) ABSTRACT

Systems and methods for controlling gas to gas-fired appliances are disclosed. An illustrative system can include a modulating gas valve adapted to supply gas to a burner unit, an inducer fan adapted to produce a combustion air flow at the burner unit, a pressure reducing element in fluid communication with the gas valve and adapted to output at least one pressure signal for sensing the combustion air flow outputted by the inducer fan, and a controller for controlling the speed of the inducer fan. The pressure reducing element can include a venturi tube, flow nozzle, or other suitable device capable of producing pneumatic signals that can be used by the gas valve to modulate the gas supplied to the burner unit. By pneumatically linking the gas valve to the actual combustion air flow, the gas valve can be operated over a wide range of firing rates by adjusting the speed of the inducer fan.

23 Claims, 5 Drawing Sheets

SYSTEMS AND METHODS FOR CONTROLLING GAS PRESSURE TO GAS-FIRED APPLIANCES

FIELD

The present invention relates generally to the field of gas-fired appliances. More specifically, the present invention pertains to systems and methods for controlling gas pressure to gas-fired appliances such as warm air furnaces.

BACKGROUND

Warm air furnaces are frequently used in homes and office buildings to heat intake air received through return ducts and distribute heated air through warm air supply ducts. Such furnaces typically include a circulation blower or fan that directs cold air from the return ducts across a heat exchanger having metal surfaces that act to heat the air to an elevated temperature. A gas burner is used for heating the metal surfaces of the heat exchanger. The air heated by the heat exchanger can be discharged into the supply ducts via the circulation blower or fan, which produces a positive airflow within the ducts. In some designs, a separate inducer fan can be used to remove exhaust gasses resulting from the combustion process through an exhaust vent.

In a conventional warm air furnace system, gas valves are typically used to regulate gas pressure supplied to the burner unit at specific limits established by the manufacturer and/or by industry standard. Such gas valves can be used, for example, to establish an upper gas flow limit to prevent over-combustion or fuel-rich combustion within the appliance, or to establish a lower limit to prevent combustion when the supply of gas is insufficient to permit proper operation of the appliance. In some cases, the gas valve regulates gas pressure independent of the inducer fan. This may permit the inducer fan to be overdriven to overcome a blocked vent or to compensate for pressure drops due to long vent lengths without exceeding the maximum gas firing rate of the furnace.

In some designs, the gas valve may be used to modulate the gas firing rate within a particular range in order to vary the amount of heating provided by the appliance. Modulation of the gas firing rate may be accomplished, for example, via pneumatic signals received from the heat exchanger, or from electrical signals received from a controller tasked to control the gas valve. While such techniques are generally capable of modulating the gas firing rate, such modulation is usually accomplished via control signals that are independent from the control of the combustion air flow. In some two-stage furnaces, for example, the gas valve may output gas pressure at two different firing rates based on control signals that are independent of the actual combustion air flow produced by the inducer fan. Since the gas control is usually separate from the combustion air control, the delivery of a constant gas/air mixture to the burner unit may be difficult or infeasible over the entire range of firing rate.

To overcome this problem, attempts to link the speed of the inducer fan to the gas firing rate have been made, but with limited efficacy. In one such solution, for example, the fan shaft of the inducer fan is used as a pump to create an air signal that can be used by the gas valve to modulate gas pressure supplied to the burner unit. Such air signal, however, is proportional to the fan shaft speed and not the actual combustion air flow, which can result in an incorrect gas/air ratio should the vent or heat exchanger become partially or fully obstructed. In some cases, such system may result in a call for more gas than is actually required, reducing the efficiency of the combustion process.

In another common modulating technique in which zero-governing gas pressure regulators and pre-mix burners are used to completely mix gas and air prior to delivery to the burner unit, an unamplified (i.e. 1:1 pressure ratio) pressure signal is sometimes used to modulate the gas valve. Such solutions, while useful in gas-fired boilers and water heaters, are often not acceptable in warm air furnaces where in-shot burners are used and positive gas pressures are required.

Other factors such as complexity and energy usage may also reduce the efficiency of the gas-fired appliance in some cases. In some conventional multi-stage furnaces, for example, the use of additional wires for driving additional actuators on the gas valve for each firing rate beyond single-stage may require more power to operate, and are often more difficult to install and control. Depending on the type of modulating actuators employed, hysteresis caused by the actuator's armature traveling through its range of motion may also cause inaccuracies in the gas flow output during transitions in firing rate.

SUMMARY

The present invention pertains to systems and methods for controlling gas pressure to gas-fired appliances such as warm air furnaces. An illustrative system can include a modulating gas valve adapted to supply gas to a burner unit, a multi speed or variable speed inducer fan adapted to produce a combustion air flow for combustion at the burner unit, a pressure reducing element in fluid communication with the gas valve, and a controller for controlling the speed of the inducer fan. The pressure reducing element can include a venturi, flow nozzle, or other suitable means for producing a differential pressure signal that can be sensed via a number of pneumatic lines in fluid communication with the gas valve. The pressure reducing element can be placed at various locations within the combustion air flow stream, including either upstream or downstream of the inducer fan.

An illustrative method of controlling gas pressure supplied to a gas-fired appliance can include the steps of providing a pressure reducing element in fluid communication with the combustion air flow produced by an inducer fan, sensing the pressure differential at the pressure reducing element and outputting a differential pressure signal to a modulating gas valve adapted to supply gas to a burner unit, and adjusting the speed of the inducer fan to control the firing rate of the gas supplied to the burner unit. By pneumatically linking the gas valve to the actual combustion air flow produced by the inducer fan via the pressure reducing element, the gas valve can be operated over a wide range of firing rates by adjusting the speed of the inducer fan.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of systems and methods are illustrated in the various views, those skilled in the art will recognize that many of the examples provided have suitable alternatives that can be utilized. While the systems and methods are described with respect to warm air furnaces, it should be understood that the gas valves and systems described herein could be applied to the control of other gas-fired appliances, if desired. Examples of other gas-fired appliances that can be controlled can include, but are not limited to, water heaters, fireplace inserts, gas stoves, gas clothes dryers, gas grills, or any other such device where gas control is desired. Typically, such appliances utilize fuels such as natural gas or liquid propane gas as the primary fuel source, although other liquid and/or gas fuel sources may be provided depending on the type of appliance to be controlled.

Figure 1:
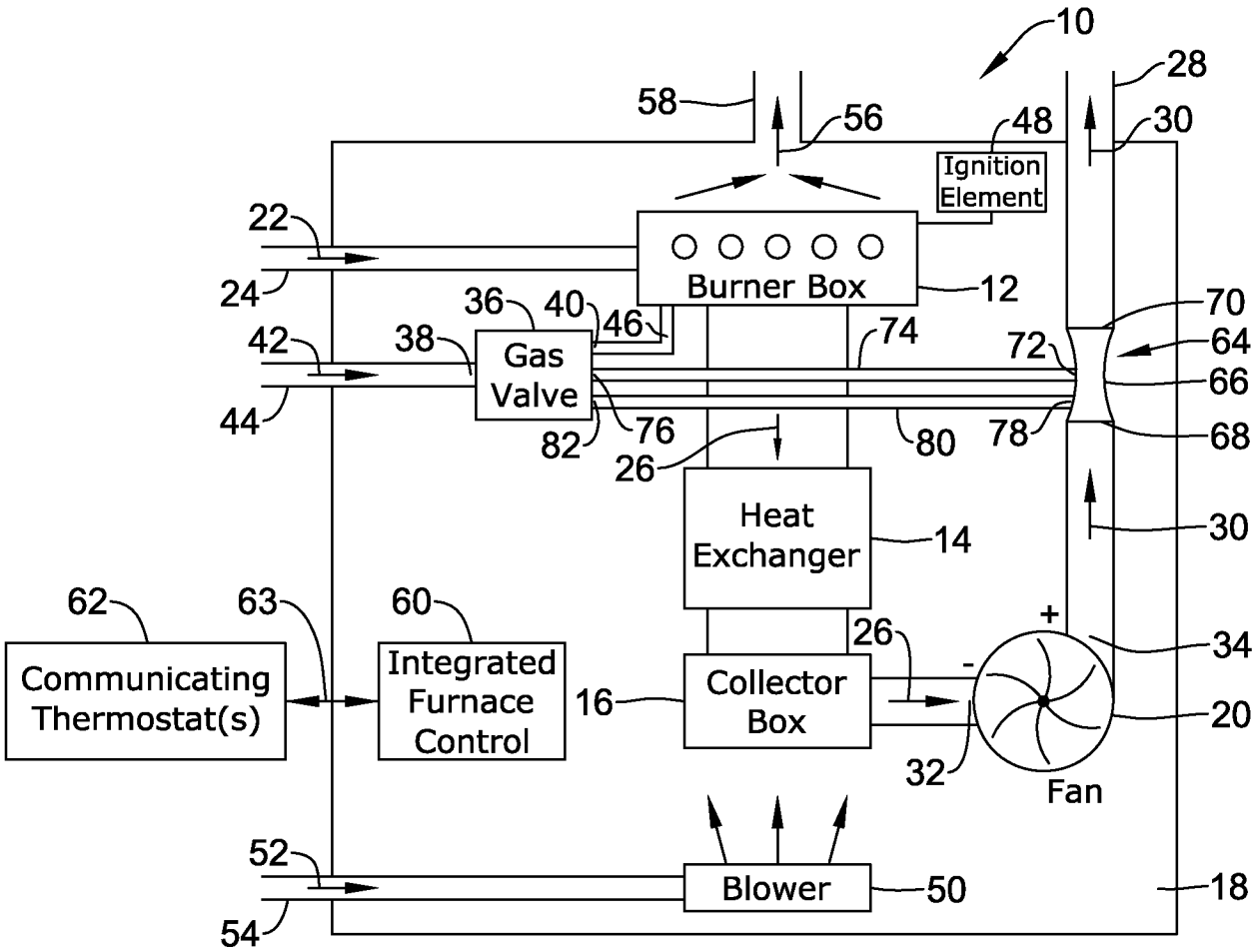
FIG. 1 is a diagrammatic view showing an illustrative system for modulating gas flow to a gas-fired appliance.

Referring now to FIG. 1, an illustrative system for modulating a gas-fired appliance 10 will now be described. The gas-fired appliance 10, illustratively a warm air furnace (WAF), can include a burner box 12, a heat exchanger 14, and a collector box 16, each of which can be housed within a furnace housing 18, as shown. An inducer fan 20 in fluid communication with the burner box 12, heat exchanger 14, and collector box 16 can be configured to draw in air 22 through an air intake 24, which can then be used for combustion of fuel within the burner box 12. Combusted air 26 discharged from the burner box 12 and fed through the heat exchanger 14 and collector box 16 can then be exhausted to a location outside of the building or structure via an exhaust vent 28.

The inducer fan 20 can be configured to produce a positive airflow in the direction indicated generally by arrow 30, forcing the combusted air 26 within the burner box 12 to be discharged through the exhaust vent 28. As indicated generally by the "+" and "−" signs in FIG. 1, the positive airflow 30 produces a change in pressure between the inlet side 32 and the outlet side 34 of the inducer fan 20 that can change the air/fuel combustion ratio within the burner box 12. In some embodiments, the inducer fan 20 can comprise a multi-speed or variable speed fan or blower capable of adjusting the combustion air flow 26 between either a number of discrete airflow positions or variably within a range of airflow positions.

A modulating gas valve 36 having a gas inlet 38 and a gas outlet 40 can be configured to regulate the supply of gas 42 that is fed to the burner box 12 for combustion. A gas supply line 44 in fluid communication with the gas inlet 38 can be configured to deliver gas to the gas valve 36, which, in turn, outputs a metered gas pressure to the burner box 12 via gas line 46. In warm air furnaces employing in-shot burners, for example, the gas valve 36 can be configured to output fuel within a particular range to permit the burners to properly ignite. In other configurations employing zero-governing gas regulators and pre-mix burners, the gas valve 36 can be configured to output a premix of air and fuel to the burner box 12 via line 46. Typically, such air-fuel premix will include a fuel such as natural gas, propane, or butane mixed with a metered amount of air, although other liquid and/or gas fuel sources may be provided depending on the type of gas-fired appliance to be controlled. The fuel fed to the burner box 12 can then be ignited via an AC hot surface ignition element, direct spark igniter, or other suitable ignition element 48.

A circulation fan or blower 50 within the furnace housing 18 can be configured to receive cold air 52 via a return-air duct 54 of the building or structure. In use, cold air 52 received via duct 54 is circulated upwardly through the gas-fired appliance 10 across the heat exchanger 14 and outputted as supply air 56 through a warm-air supply duct 58 for heating the interior of the building or structure. The fan or blower 50 can cause the warm air to exit the heat exchanger 14 through the supply duct 56 separate from the combustion air flow 26 discharged through the exhaust vent 28.

A controller 60 equipped with motor speed control capability can be configured to control various components of the gas-fired appliance 10, including the ignition of fuel by the ignition element 48, the speed and operation times of the inducer fan 20, and the speed and operation times of the fan or blower 50. In addition, the controller 60 can be configured to control various other aspects of the system including any damper and/or diverter valves connected to the supply air ducts, any sensors used for detecting temperature and/or airflow, any sensors used for detecting filter capacity, and any shut-off valves used for shutting off the supply of gas 42 to the gas valve 36. In the control of other gas-fired appliances such as water heaters, for example, the controller 60 can be tasked to perform other functions such as water level and/or temperature detection.

In some embodiments, the controller 60 can comprise an integral furnace controller (IFC) configured to communicate with one or more thermostat controllers 62 for receiving heat request signals at various locations within the building or structure. The controller 60 can be linked to each thermostat 62 via a communications bus 63 upon which heat demand signals can be communicated to the appliance 10. For example, in some embodiments the controller 60 can be configured to operate using an ENVIRACOM platform, allowing multiple devices to communicate with each other over the communications bus 63. It should be understood, however, that the controller 60 can be configured to provide connectivity via a wide range of other platforms and/or standards, as desired.

In the illustrative embodiment of FIG. 1, the gas-fired appliance 10 further includes a pressure reducing element 64 in fluid communication with the gas valve 36 and adapted to variably modulate the gas valve 36 between a number of different positions based at least in part on the pressure of the combustion air flow 26 produced by the inducer fan 20. In some embodiments, the pressure reducing element 64 can comprise a venturi tube 66 having an inlet 68 and outlet 70 in fluid communication with the downstream combustion air 26 outputted from the inducer fan 20, and a pressure port 72 in fluid communication with a pneumatic line 74 fluidly connected to a valve port 76 of the gas valve 36. During operation, and as discussed in greater detail below, the pressure drop within the pressure reducing element 64 creates a negative pressure at port 72, providing a pneumatic signal to the gas valve 36 that can be used to adjust the firing rate.

A second port 78 located upstream of port 72 and in fluid communication with the gas valve 36 via a second pneumatic line 80 can be utilized to sense the combustion air flow 26 pressure downstream of the inducer fan 20. The pneumatic line 80 can be connected to a valve port 82 of the gas valve 36. During operation, the pneumatic line 80 prevents the gas valve 36 from opening unless a sufficient flow of combustion air 26 is present within the exhaust vent 28, obviating the need for a proof-of-air flow switch within the vent 28.

Figure 2:
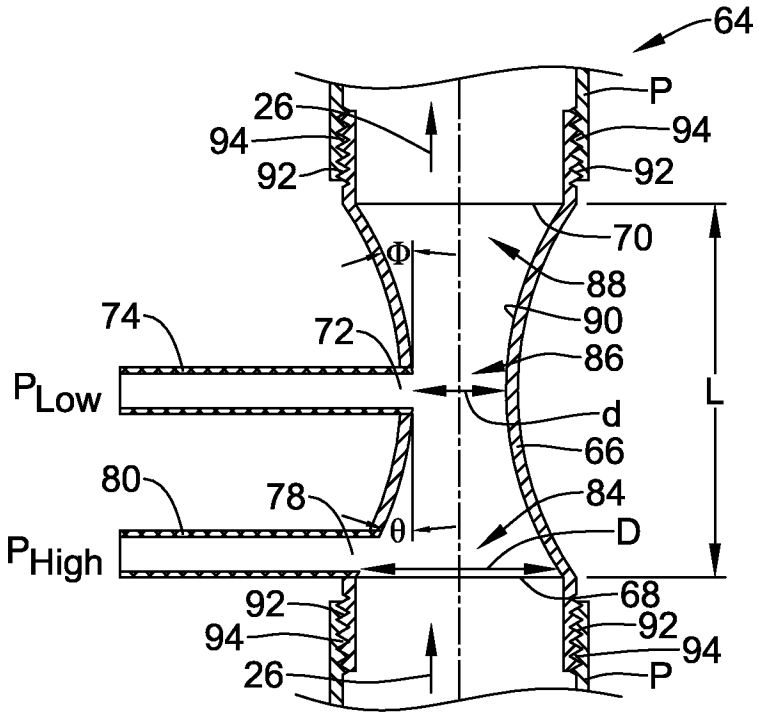
FIG. 2 is a cross-sectional view showing the illustrative pressure reducing element of FIG. 1 in greater detail.

FIG. 2 is a cross-sectional view showing the illustrative pressure reducing element 64 of FIG. 1 in greater detail. As further shown in FIG. 2, the venturi tube 66 can include a convergent entrance 84, a throat section 86, and a divergent outlet 88, which together extend along a length L. The pneumatic pressure port 72 used to sense low pressures $P_{low}$ can be formed within the side of the venturi tube 66 at or near the throat section 86 where combustion air flow 26 velocity through the tube 66 is relatively high due to the decrease in diameter d at that location. The pneumatic pressure port 80 used to sense high pressures $P_{high}$, in turn, can be formed within the side of the venturi tube 66 at or near the convergent entrance 84 where the combustion air flow 26 velocity through the tube 66 is relatively low.

The dimensions of the venturi tube 66 including the length L, throat diameter d, entrance diameter D, approach angle θ, and exit angle Φ can be selected to produce a desired pressure drop at the throat section 86 while reducing irreversible pressure head loss between the inlet 68 and outlet 70. Other factors such as the finish of the interior tube surface 90 and the length of the vent piping P both immediately upstream and downstream of the venturi tube 66 can also be selected so as to reduce head loss to the system. An example of a suitable venturi body shape can include a Herschel-type venturi tube, which is typically accurate for Reynolds numbers of between $10^5$ and $10^6$. In some embodiments, the pressure reducing element 64 can be configured to provide the same air signals to the gas valve 36 regardless of furnace construction (e.g. condensing, non-condensing, etc.), furnace size, and/or furnace efficiency, allowing the element 64 to be used with different types or lines of furnaces without adjustment.

The venturi tube 66 can comprise a separate component from the vent piping P used to exhaust the combustion gasses, or can be formed integral with the piping P. In some embodiments, for example, the venturi tube 66 can comprise a separate member that can be installed in line with the vent piping P forming the exhaust vent 28. The venturi tube 66 can be fabricated from a metal such as cast iron or stainless steel and/or a suitable polymer such as polyvinylchloride (PVC) or polypropylene (PP), or nylon. A set of threads 92 on the exterior of the venturi tube 66 can be provided to permit the venturi tube 66 to be threadably engaged with a corresponding set of threads 94 on the vent piping P. In some embodiments, the venturi body 66 and pneumatic lines 74,80 can be packaged together as a kit to permit a servicing agent to install the device within a new or existing furnace system.

Figure 3:
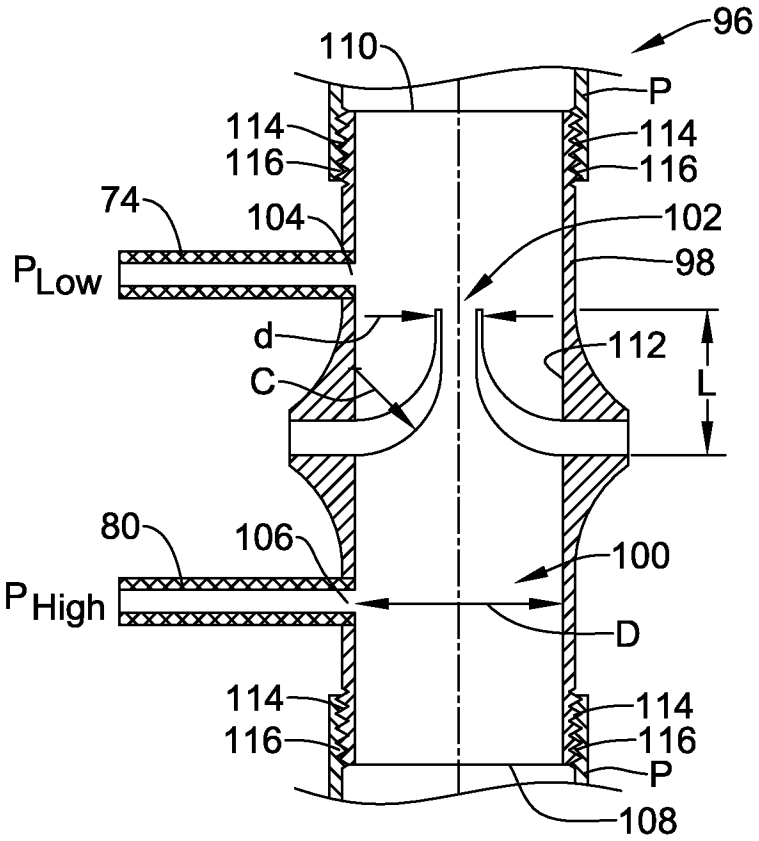
FIG. 3 is a cross-sectional view showing an alternative pressure reducing element in accordance with an illustrative embodiment.

Although the illustrative pressure reducing element 64 depicted in FIG. 2 is a venturi tube, it should be understood that other suitable devices for measuring flow such as a flow nozzle or orifice flowmeter could also be used, if desired. In one alternative pressure reducing element 96 depicted in FIG. 3, for example, a flow nozzle 98 can be utilized to pneumatically modulate the gas valve 36. The flow nozzle 98 can include a nozzle entrance 100 having a diameter D, and a nozzle outlet 102 having a diameter d. A pneumatic pressure port 104 used to sense low pressures $P_{low}$ can be formed within the side of the flow nozzle 98 at or near the location of the nozzle orifice 102 where combustion air flow 26 velocity through the flow nozzle 98 is relatively high. A second pneumatic pressure port 106 used to sense high pressures $P_{high}$, in turn, can be formed within the side of the flow nozzle 98 at or near the nozzle entrance 100 where combustion air flow 26 velocity through the flow nozzle 98 is relatively low.

As with the venturi tube 66 described above, the dimensions of the flow nozzle 98 including the length L, nozzle orifice diameter d, entrance diameter D, and approach curve C can be selected to produce a desired pressure drop at the nozzle orifice 102 while reducing irreversible pressure head loss between the inlet 108 and outlet 110 of the flow nozzle 98. Other factors such as the finish of the interior surface 112 of the flow nozzle 98 and the length of piping P both immediately upstream and downstream of the flow nozzle 98 can also be selected so as to reduce head loss to the system. A set of threads 114 disposed on the flow nozzle 98 can be provided to facilitate connection with a corresponding set of threads 116 on the vent piping P, if desired.

Referring back to FIG. 1, an illustrative method of operating the gas-fired appliance 10 will now be described. In response to a heat request signal from one or more of the thermostats 62 (e.g. from a user adjusting the temperature setpoint upwardly), the controller 60 can be configured to activate the inducer fan 20, causing the fan 20 to circulate air through the exhaust vent 28. The initial speed of the inducer fan 20 can be set based on the inputted temperature setpoint received at the thermostat 62, or can be predetermined via software and/or hardware within the controller 60. During this period, the ignition element 48 can be heated to a temperature sufficient for ignition of the burner elements within the burner box 12. In those gas-fired appliances 10 employing an AC hot surface ignition element, for example, an AC line voltage of either 120 VAC or 24 VAC can be applied to heat the element to a temperature sufficient to cause ignition.

Once the inducer 20 fan is at its proper ignition speed and the igniter is at the proper ignition temperature, the controller 60 may then power the gas valve 36, forcing metered fuel into the burner box 12 for combustion. Upon activation, the ignition element 48 may ignite the fuel causing a flame to develop. After the heat exchanger 14 warms for a predetermined period of time (e.g. 15 to 30 seconds), the circulation fan or blower 50 can then be activated to direct cold air received from the return duct 54 across the heat exchanger 14 and into the supply duct 58.

Once ignition is proven via a flame sense rod or other suitable device, the ignition element 48 can then be deactivated and the controller 60 tasked to adjust the speed of the inducer fan 20 to meet the heat demand received by the thermostat 62. As the controller 60 adjusts the speed of the inducer fan 20 either upwardly or downwardly depending on the heating demand, the combustion air flow 26 through the exhaust vent 28 will likewise change, causing a change in pressure across the pressure reducing element 64 that can be directly sensed by the gas valve 36 via the pneumatic lines 74,80. An increase in combustion air flow 26 produced by an increase in the inducer fan 20 speed, for example, will cause an increase in velocity, which based on Bernoulli's Law for an incompressible fluid flow, can be sensed by the pneumatic lines 74,80 as a differential pressure based on the following generalized equation:

$$\frac{P_{high} - P_{low}}{\rho} = \frac{V_2^2 - V_1^2}{2g_c} + \frac{(Z_2 - Z_1)g}{g_c} \quad (1)$$

where:

$P_{high}$=the pneumatic pressure at the inlet 68;

$P_{low}$=the pneumatic pressure at the throat section 86;

$V_2$=the average linear fluid velocity at the throat section 86;

$V_1$=the average linear fluid velocity at the inlet 68;

ρ=the density of the combustion gasses;

$Z_2-Z_1$=the change in elevation between the inlet 68 and throat section 86;

g=the acceleration due to gravity; and $g_c$=a dimensional constant.

Thus, as can be seen from the above equation (1), the change of pressure across the pneumatic lines ($\Delta P_{air}=P_{high}-P_{low}$) is proportional to the square of the velocity change of the combustion air flow 26 between the throat section 86 and the inlet 68 to the venturi tube 66.

The gas valve 36 can be configured to amplify the control air signals provided by the pneumatic lines 74,80, allowing the gas valve 36 to output gas pressure to the burner box 12 based on the actual combustion air flow 26 outputted by the inducer fan 20 and not an estimate thereof. An illustrative gas valve capable of pneumatically modulating gas pressure in this fashion is the VK41 or VK81 series of gas valves manufactured by Honeywell, Inc. Other gas valves capable of modulating outlet gas pressure by means of a pneumatic link between the gas and air flow could also be employed, if desired. In some embodiments, an amplification gas/air module can be employed in conjunction with the gas valve to amplify the air signals received via the pneumatic lines 74,80, if desired.

Figure 4:
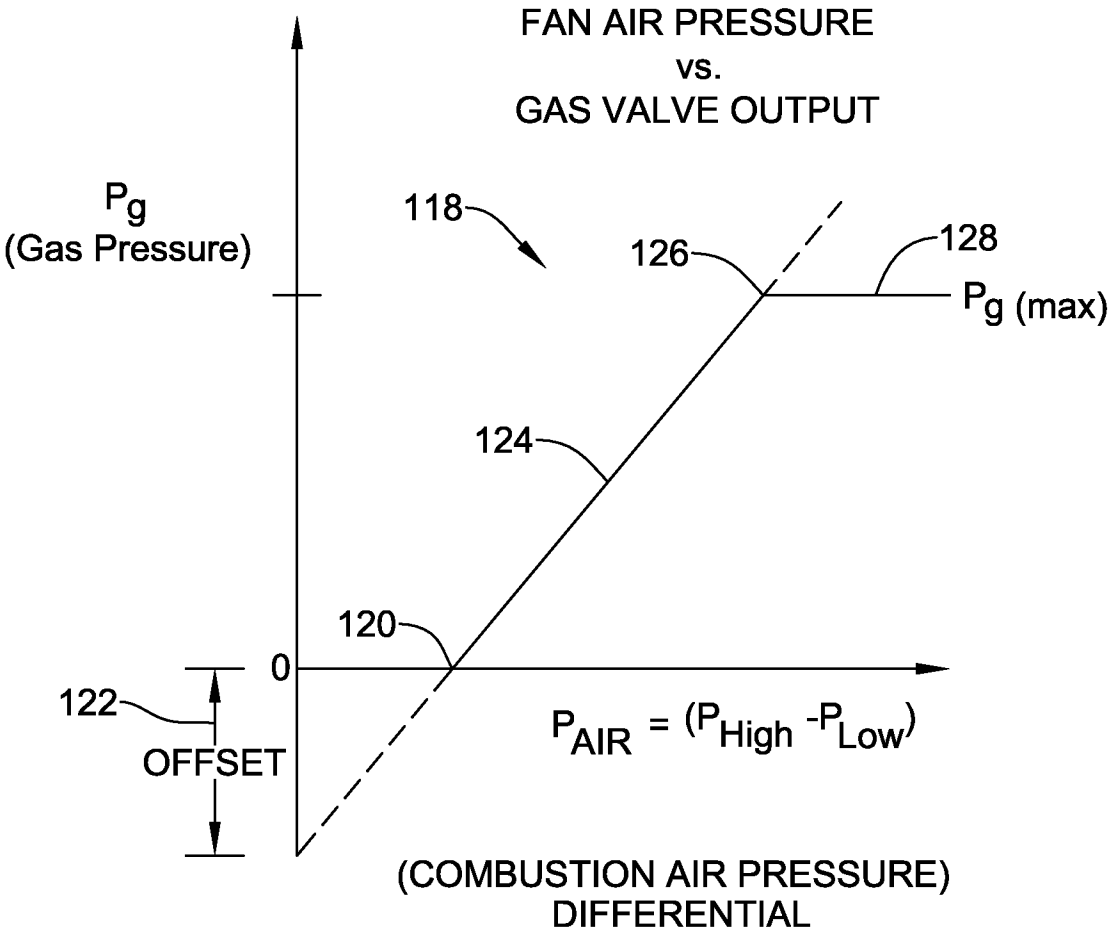
FIG. 4 is a graph showing the change in sensed combustion air pressure at the pressure reducing element versus gas valve output pressure for the illustrative system of FIG. 1.

FIG. 4 is a graph 118 showing the change of sensed combustion air pressure $\Delta P_{air}$ at the pressure reducing element 64 versus gas valve output pressure $P_g$ for the illustrative system of FIG. 1. Beginning at point 120, when a sufficient pressure differential $\Delta P_{air}$ between the pneumatic pressure lines 74,80 is sensed, the gas valve 36 can be configured to open and output gas pressure to the burner box 12. In some embodiments, the pressure differential $\Delta P_{air}$ at which the pressure reducing element 64 opens the gas valve 36 can be adjusted by a negative offset 122 so that the gas valve 36 is not opened until a minimum amount of combustion air flow 26 is present. Such offset, for example, can be utilized to prevent the gas valve 36 from opening unless a sufficient flow of combustion air 26 is present at the burner box 12. In some cases, such negative offset 122 can be used to eliminate a proof-of-air flow switch sometimes used in furnace systems to detect adequate combustion air flow.

Once the gas valve 36 is initially opened at point 120, the gas pressure $P_g$ outputted by the gas valve 36 increases in proportion to the pressure change $\Delta P_{air}$ produced by the pressure reducing element 64, as illustrated generally by ramp 124. In some embodiments, the gas valve 36 can be equipped with a high-fire pressure regulator in order to limit the gas pressure outputted from the gas valve 36 once it reaches point 126 along the ramp 124. When a high-fire pressure regulator is employed, and as illustrated generally by line 128, the gas pressure $P_g$ outputted by the gas valve 36 will not exceed a maximum gas pressure $P_{g(max)}$, thus preventing over-combustion at the burner box 12.

By pneumatically linking the gas valve to the actual combustion air flow via the pressure reducing element, the gas valve is capable of operating over a wide range of firing rates by adjusting the speed of the inducer fan. In some furnace systems, the addition of the pressure reducing element may eliminate the need to develop the air signal for the gas valve across the heat exchanger or at some other such location where the pressure drop is usually less consistent, and where relatively large head losses are required to operate the gas valve. In addition, by linking the air signal to the gas valve at a constant gas/air ratio within the band of modulation between points 120 and 126 along the ramp 124, a constant efficiency can be achieved over the entire range of firing rate.

Figure 5:
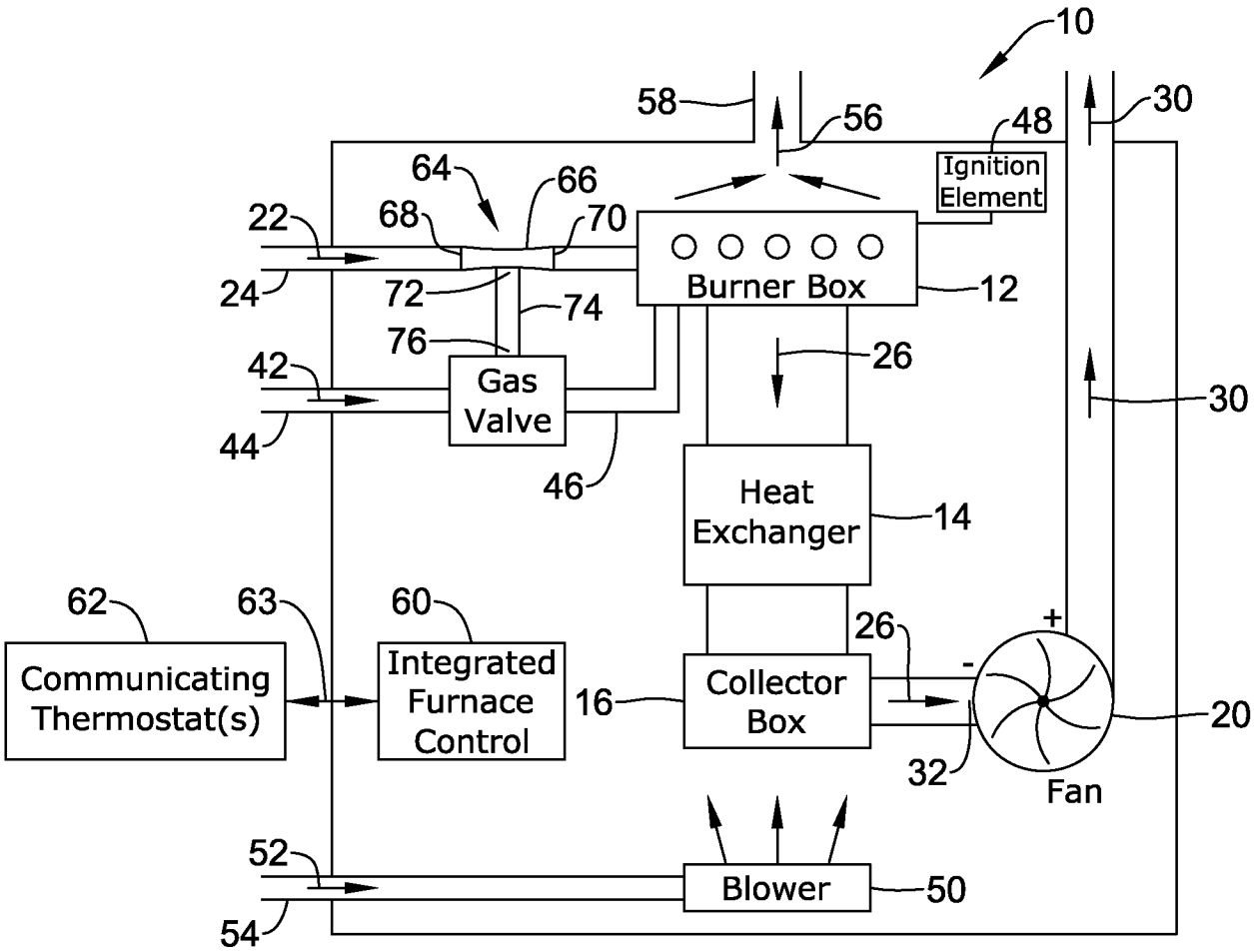
FIG. 5 is a diagrammatic view showing another alternative system for modulating gas flow to a gas-fired appliance.

Although the pressure reducing element 64 depicted in FIG. 1 is provided on the outlet side of the inducer fan 20, it should be understood that the element 64 could be installed at other locations of the exhaust system to sense combustion air flow. In one alternative system depicted in FIG. 5, for example, the pressure reducing element 64 can be positioned at a location upstream of the burner box 12 to sense air flow into the burner box 12. In this configuration, the upstream pneumatic line used to sense high pressure (i.e. pneumatic line 80) is not necessary since the high pressure signal can be developed directly from atmospheric pressure at the gas valve 36. Operation of the gas valve 36 can occur in a manner similar to that of the illustrative system of FIG. 1 by varying the speed of the inducer fan 20 via the controller 60 to modulate the gas pressure outputted by the gas valve 36.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention.

What is claimed is:

1. A system for controlling gas pressure to a gas-fired appliance, the system comprising:

a modulating gas valve for supplying a controlled amount of gas to a burner unit;

a multi or variable speed inducer fan situated downstream of the burner unit and configured to produce a combustion air flow in the burner unit and out through a vent pipe;

a pressure reducing element situated downstream of the burner unit and in fluid communication with the inducer fan and the vent pipe, the pressure reducing element configured to output at least one pneumatic signal that is related to said combustion air flow, the pressure reducing element providing the at least one pneumatic signal to the modulating gas valve, wherein the modulating gas valve is configured to amplify the at least one pneumatic signal and modulate the amount of gas supplied to the burner unit based on the amplified at least one pneumatic signal; and an appliance controller for receiving one or more control signals from a thermostat, and for controlling the speed of the inducer fan based at least in part on the one or more control signals.

2. The system of claim 1, wherein the gas valve includes at least one regulator for regulating the gas supplied to the burner unit.

3. The system of claim 1, wherein the pressure reducing element includes a venturi tube.

4. The system of claim 1, wherein the pressure reducing element includes a flow nozzle.

5. The system of claim 1, wherein the pressure reducing element is located downstream of the inducer fan.

6. The system of claim 1, wherein the pressure reducing element is located upstream of the inducer fan.

7. The system of claim 1, wherein the amplitude of said at least one pneumatic signal is proportional to the combustion air flow produced by the inducer fan.

8. The system of claim 1, wherein said at least one pneumatic signal comprises a differential pressure signal including a first pressure signal, and a second pressure signal lower than said first pressure signal.

9. The system of claim 8, further comprising:

a first pneumatic line in fluid communication with the gas valve, the first pneumatic line communicating the first pressure signal to the gas valve; and a second pneumatic line in fluid communication with the gas valve, the second pneumatic line communicating the second pressure signal to the gas valve.

10. The system of claim 1, wherein the appliance controller comprises an integral furnace controller in communication with one or more thermostat units.

11. The system of claim 1, wherein said gas-fired appliance comprises a warm air furnace.

12. A system for controlling gas pressure to a gas-fired appliance, the system comprising:

a modulating gas valve configured to supply gas to a burner unit;

a multi or variable speed inducer fan configured to produce a combustion air flow in the burner unit and out through a vent pipe;

a venturi tube in fluid communication with the inducer fan, the venture tube configured to output at least two pressure signals representing a differential pressure that is related to said combustion air flow to the modulating gas valve, wherein the modulating gas valve is configured to amplify the differential pressure from the venturi tube and modulate the amount of gas supplied to the burner unit based on the amplified differential pressure; and an appliance controller for receiving one or more control signals from one or more thermostats situated in a space to be controlled by the gas-fired appliance, and for controlling the speed of the inducer fan based at least in part on heat demand signals provided by the one or more thermostats.

13. A method of controlling gas pressure to a gas-fired appliance, the appliance including a multi or variable speed inducer fan configured to produce a combustion air flow in a burner unit, the method comprising the steps of:

providing a pressure reducing element in fluid communication with the combustion air flow produced by the inducer fan, the pressure reducing element having a curved or angled approach extending from a larger cross-section entrance to a smaller cross-section throat section;

sensing a first pressure adjacent the larger cross-section entrance of the pressure reducing element;

sensing a second pressure adjacent the throat section of the pressure reducing element;

providing a first pneumatic signal corresponding to the first pressure and a second pneumatic signal corresponding to the second pressure;

amplifying a measure related to the difference between the a first pneumatic signal and the second pneumatic signal;

modulating the amount of gas supplied to the burner unit based on the amplified measure related to the difference between the a first pneumatic signal and the second pneumatic signal; and adjusting the speed of the inducer fan to control the firing rate of gas supplied by the gas valve to the burner unit based on one or more control signals received from a thermostat that is located within a building space to be controlled by the gas-fired appliance.

14. The method of claim 13, wherein the pressure reducing element includes a venturi tube.

15. The method of claim 13, wherein the pressure reducing element includes a flow nozzle.

16. The method of claim 13, wherein the pressure reducing element is placed downstream of the inducer fan.

17. The method of claim 13, wherein the pressure reducing element is placed upstream of the inducer fan.

18. The method of claim 13, wherein said step of adjusting the speed of the inducer fan is accomplished with an appliance controller that receives a heat demand signal from the thermostat.

19. The method of claim 13, wherein a difference between the first pneumatic signal and the second pneumatic signal is in proportion to the combustion air flow produced by the inducer fan.

20. The system of claim 3, wherein the venturi tube includes one or more connection features for connecting the venturi tube in-line with the vent pipe.

21. The system of claim 20, wherein the one or more connection features includes threads situated at an end of the venturi tube.

22. The system of claim 21, wherein the one or more connection features includes threads situated at both ends of the venturi tube.

23. The system of claim 3, wherein the venturi tube is a Herschel-type venturi tube.

* * * * *